US011926976B2

(12) United States Patent
Wang et al.

(10) Patent No.: US 11,926,976 B2
(45) Date of Patent: Mar. 12, 2024

(54) PRECAST SEGMENTAL PIER REINFORCED WITH BOTH FRP BARS AND CONVENTIONAL STEEL BARS

(71) Applicant: HENGQIN GONGE TECHNOLOGY CO., LTD., Guangdong Province (CN)

(72) Inventors: Zhenyu Wang, Guangdong Province (CN); Zhongkui Cai, Guangdong Province (CN)

(73) Assignee: HENGQIN GONGE TECHNOLOGY CO., LTD., Guangdong Province (CN)

( * ) Notice: Subject to any disclaimer, the term of this patent is extended or adjusted under 35 U.S.C. 154(b) by 880 days.

(21) Appl. No.: 16/967,270

(22) PCT Filed: Feb. 1, 2019

(86) PCT No.: PCT/CN2019/074424

§ 371 (c)(1),
(2) Date: Aug. 4, 2020

(87) PCT Pub. No.: WO2019/149271

PCT Pub. Date: Aug. 8, 2019

(65) Prior Publication Data

US 2021/0054583 A1 Feb. 25, 2021

(30) Foreign Application Priority Data

Feb. 5, 2018 (CN) ..... 201820196065.1

(51) Int. Cl.
*E01D 19/02* (2006.01)
*E04C 3/34* (2006.01)
(Continued)

(52) U.S. Cl.
CPC ..... *E01D 19/02* (2013.01); *E04C 3/34* (2013.01); *E04C 5/02* (2013.01); *E04C 5/07* (2013.01); *E04C 5/08* (2013.01)

(58) Field of Classification Search
CPC ... E01D 19/02; E04C 3/34; E04C 5/02; E04C 5/07; E04C 5/08
(Continued)

(56) References Cited

U.S. PATENT DOCUMENTS 3,685,934 A * 8/1972 Huber ..... E04G 15/04 249/43
5,228,807 A * 7/1993 Willcox, Jr. ..... E02D 5/60 405/257
(Continued)

FOREIGN PATENT DOCUMENTS

CN 102409606 A 4/2012
CN 103074847 A 5/2013
(Continued)

OTHER PUBLICATIONS

International Search Report for PCT/CN2019/074424 dated Apr. 29, 2019.

*Primary Examiner* — Raymond W Addie
(74) *Attorney, Agent, or Firm* — The PL Law Group, PLLC

(57) ABSTRACT

A precast segmental pier reinforced with both FRP bars and steel bars according to one or more embodiments of the present application includes a footing, a segmental pier, longitudinal bars and unbonded post-tensioned tendons, characterized in that: the segmental pier is comprised of one or more precast segments, the longitudinal bars are comprised of both the steel bar and the high-strength steel bar, connecting the footing and the segmental pier together with unbonded post-tensioned tendons to form an entire pier.

14 Claims, 4 Drawing Sheets

(51) Int. Cl.
*E04C 5/02* (2006.01)
*E04C 5/07* (2006.01)
*E04C 5/08* (2006.01)

(58) Field of Classification Search
USPC ..... 14/14, 73–78
See application file for complete search history.

(56) References Cited

U.S. PATENT DOCUMENTS 6,123,485 A * 9/2000 Mirmiran ..... E04C 3/29 405/232
6,295,782 B1 * 10/2001 Fyfe ..... E04C 5/07 52/359
6,938,392 B2 * 9/2005 Fouad ..... E04H 12/12 52/223.4
7,445,405 B2 * 11/2008 Yurkevich ..... E02D 5/48 405/257
7,546,656 B2 * 6/2009 Kim ..... E01D 2/00 14/77.3
8,341,788 B2 * 1/2013 Kim ..... E01D 19/00 14/77.3
8,464,482 B2 * 6/2013 Raynor ..... E04C 3/34 52/169.9
8,578,537 B2 * 11/2013 Ley ..... E04C 3/20 52/252
9,267,286 B2 * 2/2016 Kim ..... E04C 5/0604
11,427,975 B2 * 8/2022 Wang ..... E01D 19/02

FOREIGN PATENT DOCUMENTS

CN 103374881 A 10/2013
CN 108252203 A 7/2018
CN 208280002 U 12/2018
JP 2003-253761 A 9/2003

* cited by examiner

PRECAST SEGMENTAL PIER REINFORCED WITH BOTH FRP BARS AND CONVENTIONAL STEEL BARS

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/CN2019/074424, filed Feb. 1, 2019, which claims priority to the benefit of Chinese Patent Application No. 201820196065.1 filed in the Chinese Intellectual Property Office on Feb. 5, 2018, the entire contents of which are incorporated herein by reference.

TECHNICAL FIELD

The invention relates to a precast segmental pier, in particular to a precast segmental pier reinforced with both fiber reinforced polymer (FRP) bars and conventional steel bars.

BACKGROUND OF THE INVENTION

In recent years, some studies on the precast segmental piers have been carried out in order to realize the rapid construction of reinforced concrete piers. By adopting prefabrication technology, the pier is vertically divided into several pier segments, and each segment is prefabricated separately in factory then transported to the bridge construction site and assembled; generally, the unbonded post-tensioned tendons arranged vertically are adopted to connect each segment to achieve the entire pier. In this way, the construction is more efficient. However, as a result of the fact that segment joints exist, the integrity of the pier precast segmental pier is reduced compared with a cast-in-situ reinforced concrete pier, and corrosion medium such as rainwater, river water and particularly seawater carrying chloride ions are easier to penetrate into the interior of the pier through the joints. The corrosion of the longitudinal steel bars of the pier is obviously accelerated by the chloride ions, so that the bearing capacity of the pier is seriously degraded, and the safety problem of the bridge structure occurs. Therefore, it is necessary to make intensive research and development to delay or avoid the corrosion of the longitudinal bars at the joints of the segments. However, an effective approach for improving the durability of the precast segmental pier is not available.

On the other hand, research and application of the precast segmental pier are mainly dedicated to improving the construction efficiency or reducing the damage of the pier after the earthquake, but research on reducing the maximum displacement response and the post-earthquake residual displacement of the pier is very limited. The existing research shows that the maximum displacement response and the discreteness of the pier during earthquake can be effectively reduced by improving the post-yield stiffness. Besides, the self-centering capacity of the pier can be obviously improved, and the serviceability of the pier after earthquake disasters is guaranteed, so that the earthquake relief and the re-construction can be carried out successfully. However, a well-established approach of effectively improving the post-yielding stiffness of the precast segmental pier is not available.

In recent years, FRP has been increasingly used in bridge engineering and construction fields due to its excellent properties of light weight, high strength and corrosion resistance, et al. The research of applying FRP fabrics, plates and FRP bars to improve the seismic performance of structures or members has achieved many important results. Therefore, the FRP bars are used for improving the post-yielding stiffness and durability of the precast segmental pier, and a new invention is provided for solving aforementioned two problems in the research of the precast segmental pier. However, the specific research and development and application of the FRP bars to solve the two problems are not available as well.

SUMMARY

The invention aims to provide a precast segmental pier reinforced with both FRP bars and conventional steel bars. Conventional steel bar is easily corroded by suffering from the corrosion of the chloride ions which leads to the reduction of the diameter of bars. The tensile strength of conventional steel bars is between 400 MPa and 500 MPa, and corresponding tensile yield strain is between 0.2% and 0.3%, and the modulus hardening ratio after yielding is very little, hence, it is approximately an ideal elastoplasticity material. The FRP bar has excellent chloride ion corrosion resistance, the tensile strength range is 600 MPa to 2200 MPa, the ultimate tensile strain is 1.0% to 4.4%, and the linear elastic stress-strain relationship is basically maintained when the tensile stress of the FRP bar is smaller than the ultimate tensile strain. Therefore, two kinds of longitudinal bars, namely the FRP bars and the conventional steel bars, are simultaneously incorporated into the pier, the conventional steel bars are positioned on the inner side of the FRP bars in the cross-section, the thickness of the concrete cover of the conventional steel bars is increased, and the initial corrosion time of the bars is effectively delayed, thereby effectively delaying the performance degradation caused by the corrosion of the longitudinal steel bars in the service period of the bridge structure; meanwhile, the linear elastic characteristics of the FRP bars are utilized to improve the post-yielding stiffness, load-carrying capacity, energy dissipation capacity and displacement ductility of the pier, so that the maximum displacement response and the discreteness of the pier under earthquake excitations are effectively reduced, the self-centering capacity of the pier is improved, the residual displacement after earthquake is reduced, and the post-earthquake serviceability and the repairability of the pier are improved.

The invention provides a precast segmental pier reinforced with both FRP bars and conventional steel bars, comprising a footing 1, a segmental pier 2, longitudinal bars 6 and unbonded post-tensioned tendons 7, characterized in that: the segmental pier 2 is composed of one or more precast segments 4, the longitudinal bars 6 are composed of both the conventional steel bar 10 and the high-strength steel bar 11, connecting the footing 1 and the segmental pier 2 together with unbonded post-tensioned tendons 7 to form an entire pier.

The geometric dimension, the reinforcement and the materials of each precast segment 4 can be the same, so that the assembling is easier, and the construction efficiency is improved; and can also be different so as to reduce the prefabrication cost of the pier. The upper surface and the lower surface of each precast segment 4 can be flat, so that the shearing force generated under the earthquake is effectively transmitted between the upper precast segment and the lower precast segment mainly by a friction mechanism. In addition, according to the requirement of seismic design, the upper surface and the lower surface of the precast segment 4 can be provided with one or more shear keys, so that the upper precast segment and the lower precast segment are interlocked, and the shear bearing capacity at the segment joints can be effectively improved.

Conventional steel bars can be HRB400, HRB500, HRBF400, HRBF500, HRB400E, HRB500E, HRBF400E or HRBF 500E. The FRP bars 6 can be BFRP bars, CFRP bars, GFRP bars or AFRP bars.

Corrugated ducts 5 are reserved in the footing 1 and each precast segment 4. The corrugated duct 5 is realized by embedding a metal corrugated pipe in advance, the corrugated pipe is a galvanized metal corrugated pipe, and the corrugated pipe meets the requirements of the specification of metal corrugated pipes for prestressed concrete (JG 225-2007). The lower end of the unbonded post-tensioned tendons 7 are anchored in the footing 1, the tendons sequentially pass through the ducts for post-tensioned tendons 8 with smooth inner wall reserved in each precast segment 4 when the pier is assembled, and the upper tendons are anchored in the recess for the anchor of post-tensioned tendons 3. The unbonded prestressed tendons 7 can be steel strands, deformed steel bars or FRP bars.

A FRP bar 11 and a conventional steel bar 10 are placed in the same corrugated duct 5, and to accurately determine the geometric positions of these two longitudinal bars 6, a locating brace for longitudinal bars 13 is employed. And the locating brace for longitudinal bars 13 is arranged at intervals of 2 to 5 meters along the vertical direction of the longitudinal bars, so that the FRP bars 11 and the conventional steel bars 10 in the corrugated duct are generally fixed.

The present invention has the following advantageous effects compared with the prior art:

In the precast segmental pier provided by the invention, the FRP bars with excellent corrosion resistance are positioned on the outer side, and the conventional steel bars which are easy to be corroded by chloride ions are positioned on the inner side, so that the concrete cover of the conventional steel bars is obviously thickened, the initial corrosion time of the conventional steel bars is greatly delayed, and the durability of the precast segmental pier is obviously improved.

The longitudinal bars are composed of a conventional steel bar with a lower yielding point and a FRP bar with elasticity and higher strength, and can obviously improve the post-yield stiffness of the precast segmental pier, thereby reducing the maximum displacement response and the discreteness of the precast segmental pier under earthquake excitation, effectively improving the self-centering capability of the precast segmental pier, reducing the residual displacement and improving the serviceability of the bridge structure after earthquake.

By adjusting the proportion of the FRP bars and the conventional steel bars, the yield load capacity, the post-yield stiffness, the peak load capacity and the ultimate drift ratio of the precast segmental pier can be effectively controlled, and therefore the design of the precast segmental pier at multiple performance levels is achieved.

The precast segmental pier provided by the invention has outstanding hysteretic energy dissipation capability and can effectively absorb and dissipate energy input to a bridge structure during earthquake, so that an energy dissipation damper or an isolation bearing does not need to be additionally arranged, and the bridge construction cost is reduced.

The longitudinal bars of the precast segmental pier are constrained by the surrounding high-strength grouting material, and the outside of the high-strength grouting material is also confined by the metal corrugated pipe and the steel hoops, so that the longitudinal bars generally do not suffer from buckling failure under compression during an earthquake; on the other hand, the high-strength grouting material confined by the metal corrugated pipe can resist compression together with the concrete, so that the compression stress level and the degree of damage of the concrete can be lower. Therefore, the precast segmental pier provided by the invention has more reparability after earthquake, and helps rapidly recover the bridge traffic network in the earthquake disaster areas.

DETAILED DESCRIPTION

Figure 1:
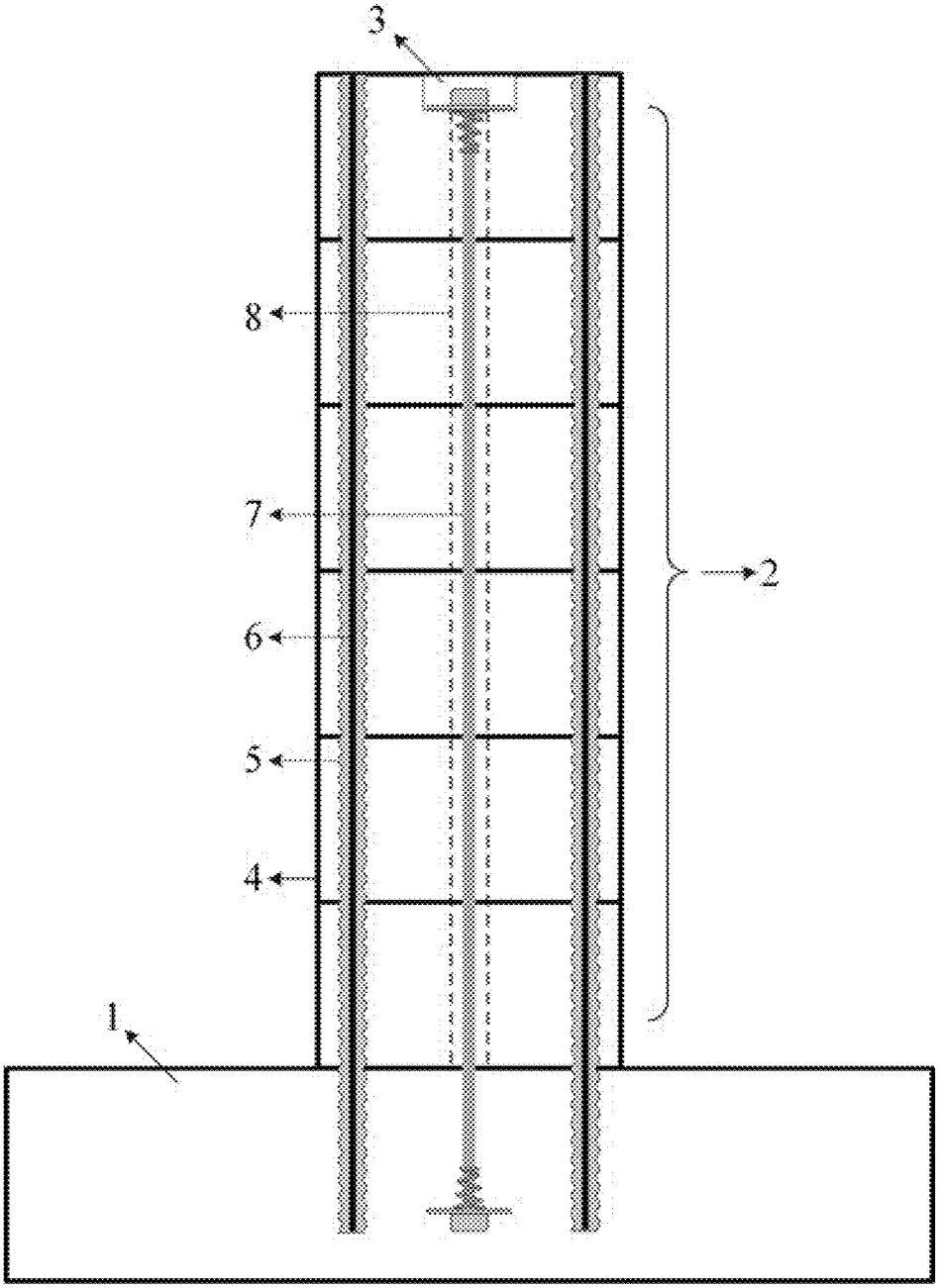
FIG. 1 is a schematic longitudinal cross-sectional view of a precast segmental pier according to embodiment 1.
Figure 2:
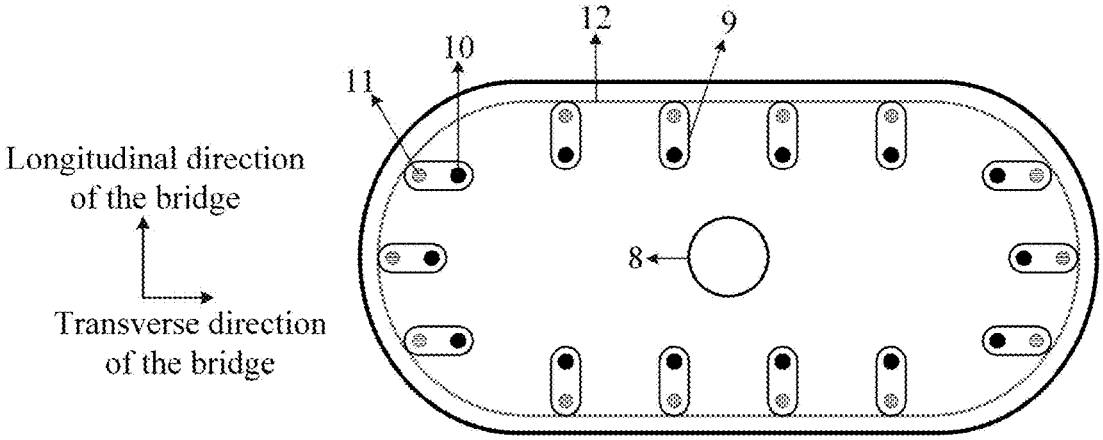
FIG. 2 is a schematic cross-sectional view of a precast segmental pier according to embodiment 1.
Figure 3:
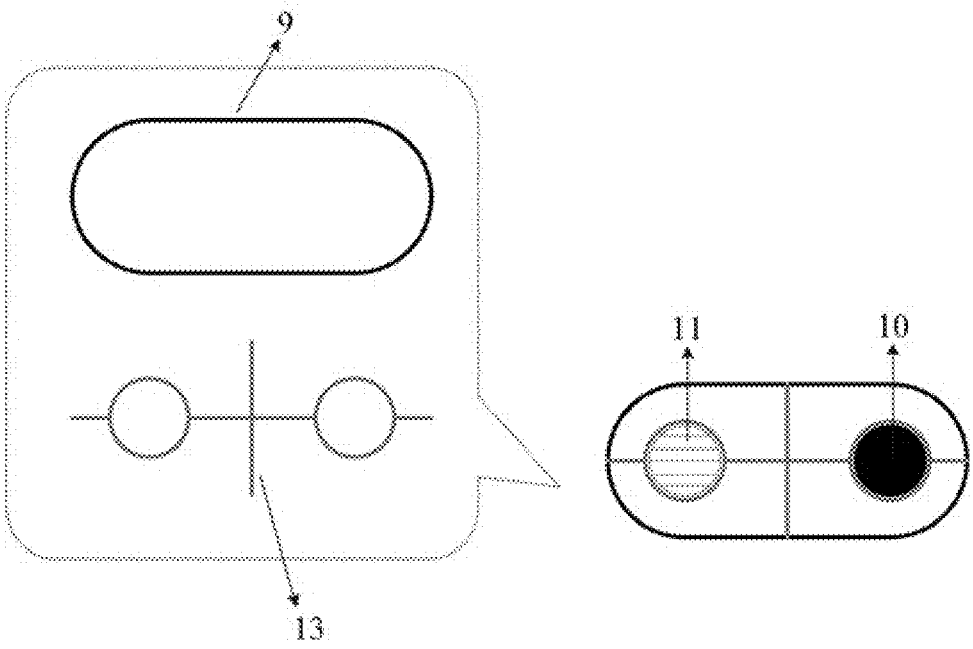
FIG. 3 is a schematic view of a locating brace for longitudinal bars according to embodiment 1.

The invention is described in further detail below with reference to the following figures and embodiments:

Embodiment 1, as shown in FIG. 1, the invention provides a precast segmental pier reinforced with both FRP bars 11 and conventional steel bars 10, comprising a footing 1, a segmental pier 2, longitudinal bars 6 and unbonded post-tensioned tendons 7. The segmental pier 2 is composed of one or more precast segments 4, and the footing 1 and the segmental pier 2 are connected together by unbonded post-tensioned tendons 7 to form an entire pier. Each precast segment 4 has a round-ended cross-section with the same cross-sectional dimension and the same segment height. The height of the segments is 1.5 to 4 times of the size of the long side of the section, so that the plastic hinge of the precast segmental pier can be fully developed to ensure the energy dissipation capacity in seismic design, and the volume and the weight of a single precast segment 4 are small for assembling conveniently. Each precast segment 4 is provided with the same number of corrugated ducts 5 at the same cross-sectional position. Therefore, the corrugated ducts 5 and the ducts for post-tensioned tendons 8 can be achieved after assembly. After the precast segments 4 are assembled and the unbonded post-tensioned tendons 7 are tensioned, the longitudinal bars 6 are placed into the corrugated ducts 5. If the length of the single longitudinal bar 6 is smaller than the height of the segmental pier 2, the longitudinal bar 6 is extended in the approach of mechanical connection, welding or binding connection. The longitudinal bars 6 are composed of a FRP bar 11 and a conventional steel bar 10, and the ratio of the reinforcement ratio of the FRP bar 11 to the reinforcement ratio of the conventional steel bar 10 is 0.5 to 2.0. The post-yielding stiffness of the precast segmental pier can be effectively improved by configuring the two kind of longitudinal bars, so that the seismic performance and the self-centering capability of the precast segmental pier are comprehensively improved. More importantly, as shown in FIG. 2, the corrosion-resistant FRP bars 11 are positioned on the outer side of the cross section, and the conventional steel bars 10 are positioned on the inner side of the cross section, so that the durability of the precast segmental pier can be remarkably improved. To accurately determine the geometric positions of these two longitudinal bars, a locating brace for longitudinal bars 13 is employed. And the locating brace for longitudinal bars 13 is arranged at intervals of 2 to 5 meters along the vertical direction of the longitudinal bars, and the locating brace for longitudinal bars 13 is shown in FIG. 3. After the longitudinal bars 6 are placed, pressure grouting is carried out in the corrugated ducts 5, and grouting quality is ensured. The longitudinal bars 6 are restrained by the surrounding grouting material, the metal corrugated pipes 9 and the steel hoops 12, so that the longitudinal bars generally do not suffer from buckling failure under compression during an earthquake. The high-strength grouting material confined by the metal corrugated pipe can resist compression together with the concrete, so that the compression stress level and the degree of damage of the concrete can be lower. Therefore, the precast segmental pier has better durability and post-seismic performance than the cast-in-situ pier, and reduces the maintenance cost of the bridge, accelerates the construction of the bridge and ensures the rapid recovery of the bridge traffic network in the earthquake disaster areas.

Figure 4:
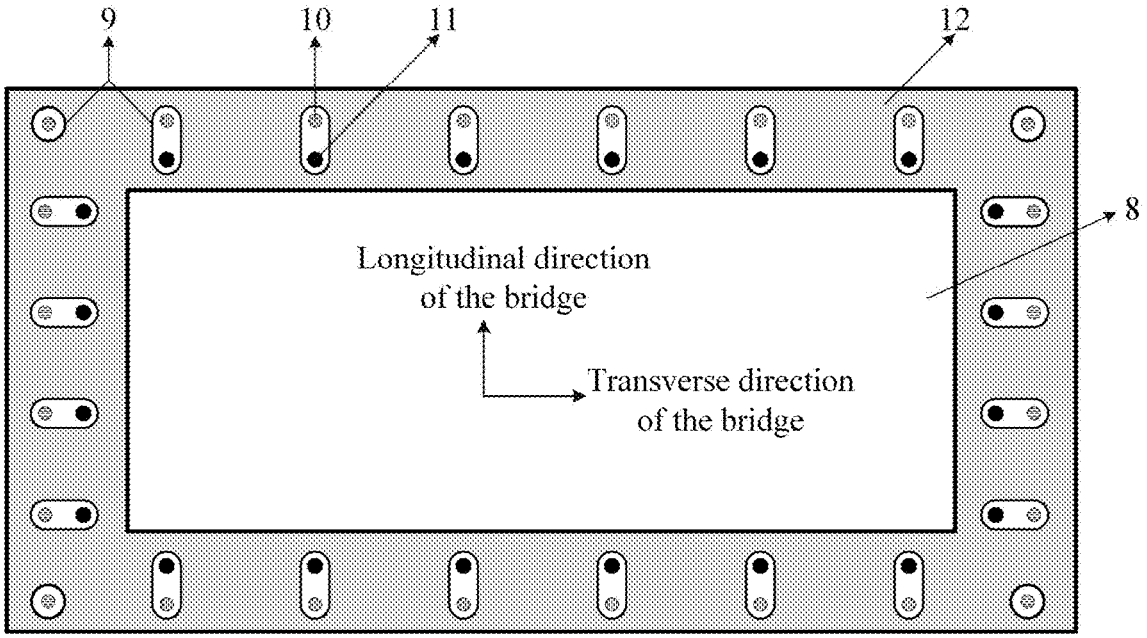
FIG. 4 is a schematic longitudinal cross-sectional view of a precast segmental pier according to embodiment 2.

2. Embodiment 2, as shown in FIG. 4, the difference between this embodiment and the embodiment 1 is that the precast segmental pier is a rectangular thin-walled hollow section, the four corners of the cross-section are provided with the corrugated ducts 5 using circular metal corrugated pipes 9, and the rest are provided with the corrugated ducts 5 using flat metal corrugated pipes 9. Only one FRP bar is placed in each circular corrugated ducts 5, and both a FRP bar 11 and a conventional steel bar 10 are placed in each flat corrugated ducts 5. When the precast segmental pier reinforced with both FRP bars 11 and conventional steel bars 10 has a rectangular thin-wall hollow cross-section, the FRP bars can be close to the edge of the cross-section, so that the tensile strength of the FRP bars can be more fully utilized, and the post-yield stiffness of the precast segmental pier is improved; meanwhile, the concrete cover of the conventional steel bars is obviously thickened, the initial corrosion time of the conventional steel bars is greatly delayed, and the durability of the precast segmental pier is obviously improved.

Figure 5:
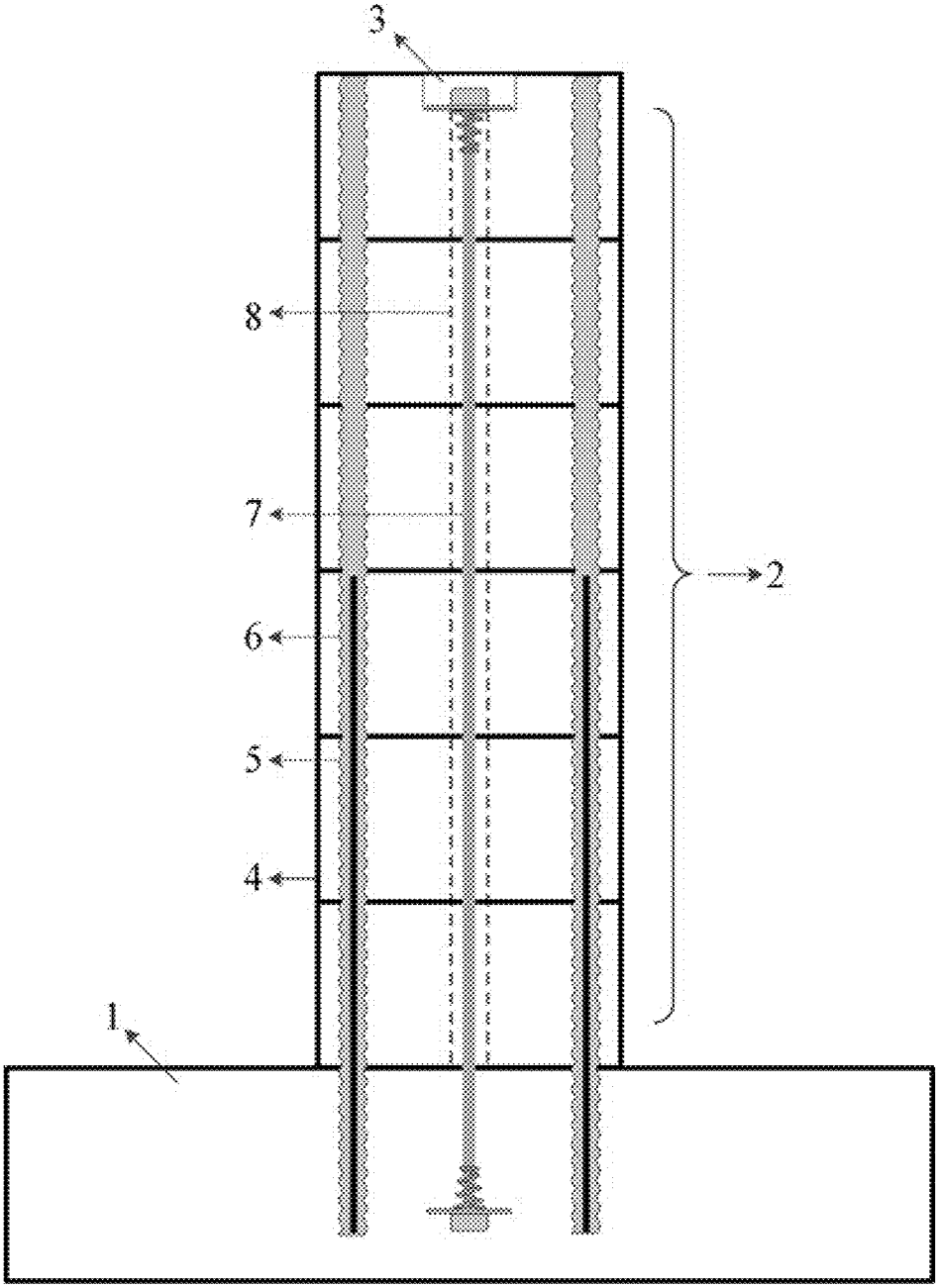
FIG. 5 is a schematic longitudinal cross-sectional view of a precast segmental pier according to embodiment 3.

3. Embodiment 3, as shown in FIG. 5, the present embodiment is different from the embodiment 1 in that FRP bars and conventional steel bars only pass through several precast segments of the lower part of the segmental pier, and are not arranged along the whole pier. For a cantilever pier, the bending moment of the bottom of the pier is the largest under the action of an earthquake, and the bending moment is gradually reduced from the bottom of the pier to the top of the pier. In seismic design, longitudinal bar reinforcement ratio can be gradually reduced according to bending moment distribution of pier, and finally, the longitudinal bar is cut at a certain reasonable height. The cutting of the longitudinal bar is in accordance with the corresponding seismic design specification. Because the cost of the FRP bar is higher than that of the conventional steel bar, when the height of the pier reinforced with both FRP bars and conventional steel bars is larger, the amount of FRP bars and conventional steel bars can be effectively reduced by this method while the seismic performance is ensured, so that the economic benefit and the construction efficiency are favorably improved.

Finally, the above embodiments are only used to illustrate the technical solution of the present invention and are not limited.

What is claimed is:

1. A precast segmental pier reinforced with both fiber reinforced polymer (FRP) bars and steel bars, comprising a footing, a segmental pier, longitudinal bars and unbonded post-tensioned tendons, characterized in that: the segmental pier is comprised of one or more precast segments, the longitudinal bars are comprised of both the FRP bar and the steel bar, connecting the footing and the segmental pier together with unbonded post-tensioned tendons to form an entire pier, wherein the cross-section of the precast segmental pier is a rectangular thin-walled hollow section, the four corners of the cross-section are provided with the corrugated ducts using circular metal corrugated pipes, and the rest are provided with the corrugated ducts using flat metal corrugated pipes; only one FRP bar is placed in each circular corrugated ducts, and both a FRP bar and a steel bar are placed in each flat corrugated ducts.

2. The precast segmental pier reinforced with both the FRP bars and the steel bars according to claim 1, wherein: the ratio of the reinforcement ratio of the FRP bar to the reinforcement ratio of the steel bar is 0.5 to 2.0, and the longitudinal bars are arranged symmetrically in the cross-section.

3. The precast segmental pier reinforced with both the FRP bars and the steel bars according to claim 1, wherein: the upper surface and the lower surface of each precast segment are flat or be provided with one or more shear keys.

4. The precast segmental pier reinforced with both the FRP bars and the steel bars according to claim 1, wherein: corrugated ducts are reserved in the footing and each precast segment, the FRP bar and the steel bar are placed in the same corrugated duct.

5. The precast segmental pier reinforced with both the FRP bars and the steel bars according to claim 1, wherein: the FRP bars are positioned on the outer side of the cross section, and the steel bars are positioned on the inner side of the cross section.

6. The precast segmental pier reinforced with both the FRP bars and the steel bars according to claim 1, wherein: steel bars are HRB400, HRB500, HRBF400, HRBF500, HRB400E, HRB500E, HRBF400E or HRBF 500E, and the FRP bars are BFRP bars, CFRP bars, GFRP bars or AFRP bars.

7. The precast segmental pier reinforced with both the FRP bars and the steel bars according to claim 6, wherein: the lower end of the unbonded post-tensioned tendons are anchored in the footing, the tendons sequentially pass through the ducts for post-tensioned tendons with smooth inner wall reserved in each precast segment when the pier is assembled, and the upper tendons are anchored in the recess for the anchor of post-tensioned tendons.

8. The precast segmental pier reinforced with both the FRP bars and the steel bars according to claim 6, wherein: the unbonded prestressed tendons are steel strands, deformed steel bars or FRP bars.

9. The precast segmental pier reinforced with both the FRP bars and the steel bars according to claim 7, wherein: the unbonded prestressed tendons are steel strands, deformed steel bars or FRP bars.

10. A precast segmental pier reinforced with both fiber reinforced polymer (FRP) bars and steel bars, comprising a footing, a segmental pier, longitudinal bars and unbonded post-tensioned tendons, characterized in that: the segmental pier is comprised of two or more precast segments, the longitudinal bars are comprised of both the FRP bar and the steel bar, connecting the footing and the segmental pier together with unbonded post-tensioned tendons to form an entire pier; the steel bar and the high-strength steel bar only pass through several precast segments of the lower part of the segmental pier, and are not arranged along the entire pier, wherein the cross-section of the precast segmental pier is a rectangular thin-walled hollow section, the four corners of the cross-section are provided with the corrugated ducts using circular metal corrugated pipes, and the rest are provided with the corrugated ducts using flat metal corrugated pipes; only one FRP bar is placed in each circular corrugated ducts, and both a FRP bar and a steel bar are placed in each flat corrugated ducts.

11. The precast segmental pier reinforced with both the FRP bars and the steel bars according to claim 10, wherein: the upper surface and the lower surface of each precast segment are flat or be provided with one or more shear keys.

12. The precast segmental pier reinforced with both the FRP bars and the steel bars according to claim 10, wherein: corrugated ducts are reserved in the footing and each precast segment, the FRP bar and the steel bar are placed in the same corrugated duct.

13. The precast segmental pier reinforced with both the FRP bars and the steel bars according to claim 10, wherein: the FRP bars are positioned on the outer side of the cross section, and the steel bars are positioned on the inner side of the cross section.

14. The precast segmental pier reinforced with both the FRP bars and the steel bars according to claim 10, wherein: the ratio of the reinforcement ratio of the FRP bar to the reinforcement ratio of the steel bar is 0.5 to 2.0, and the longitudinal bars are arranged symmetrically in the cross-section.

* * * * *